US007448307B1

(12) United States Patent
Dafinov

(10) Patent No.: US 7,448,307 B1
(45) Date of Patent: Nov. 11, 2008

(54) GAS OPERATED SEMI-AUTOMATIC RIFLE

(76) Inventor: Vesselin Dafinov, 877 114th Ave. North, Apt. 404, St. Petersburg, FL (US) 33716

( * ) Notice: Subject to any disclaimer, the term of this patent is extended or adjusted under 35 U.S.C. 154(b) by 375 days.

(21) Appl. No.: 11/485,735

(22) Filed: Jul. 13, 2006

Related U.S. Application Data

(60) Provisional application No. 60/721,679, filed on Sep. 30, 2005.

(51) Int. Cl.
*F41A 5/18* (2006.01)

(52) U.S. Cl. ..... 89/191.01

(58) Field of Classification Search ..... 89/153, 89/179, 191.01, 192, 193
See application file for complete search history.

(56) References Cited

U.S. PATENT DOCUMENTS

| | | | | | |
|---|---|---|---|---|---|
| 3,093,922 | A * | 6/1963 | Ivy | 42/62 |
| 3,261,264 | A | 7/1966 | Wilson | |
| 3,618,457 | A * | 11/1971 | Miller | 89/185 |
| 3,960,053 | A * | 6/1976 | Conley | 89/149 |
| 3,990,346 | A | 11/1976 | Irwin | |
| 4,061,075 | A | 12/1977 | Smith | |
| 4,232,583 | A * | 11/1980 | Harrison | 89/153 |
| 4,635,530 | A * | 1/1987 | Weldle | 89/159 |
| 4,909,129 | A * | 3/1990 | Reynolds | 89/191.01 |
| 5,123,329 | A | 6/1992 | Irwin | |
| 5,351,598 | A | 10/1994 | Schuetz | |
| 5,520,019 | A | 5/1996 | Schuetz | |
| 5,834,678 | A * | 11/1998 | Kalb | 89/187.01 |
| 5,886,281 | A * | 3/1999 | Kirstein | 89/185 |
| 5,939,659 | A | 8/1999 | Dobbins | |
| 5,983,774 | A * | 11/1999 | Mihaita | 89/187.02 |
| 6,227,098 | B1 * | 5/2001 | Mason | 89/193 |
| 6,606,934 | B1 | 8/2003 | Rock et al. | |
| 6,619,592 | B2 * | 9/2003 | Vignaroli et al. | 89/191.01 |
| 6,622,610 | B2 * | 9/2003 | Adkins | 89/193 |
| 6,848,351 | B1 * | 2/2005 | Davies | 89/191.01 |
| 2007/0131104 | A1 * | 6/2007 | Botty | 89/193 |

* cited by examiner

*Primary Examiner*—Bret Hayes
(74) *Attorney, Agent, or Firm*—Thomas Frost

(57) ABSTRACT

A gas operated semi-automatic rifle is disclosed having a forwardly moving gas piston located under the discharge end of a barrel. The gas piston is connected to a locking mechanism. The locking mechanism is engaged with a breechblock. As the gas piston moves a short distance forward after a round has been fired from the rifle, the locking mechanism moves rearward and disengages from the breechblock. The breechblock is biased rearward by being disengaged from the locking mechanism. The breechblock strips a new cartridge from a magazine, and reloads the rifle.

8 Claims, 10 Drawing Sheets

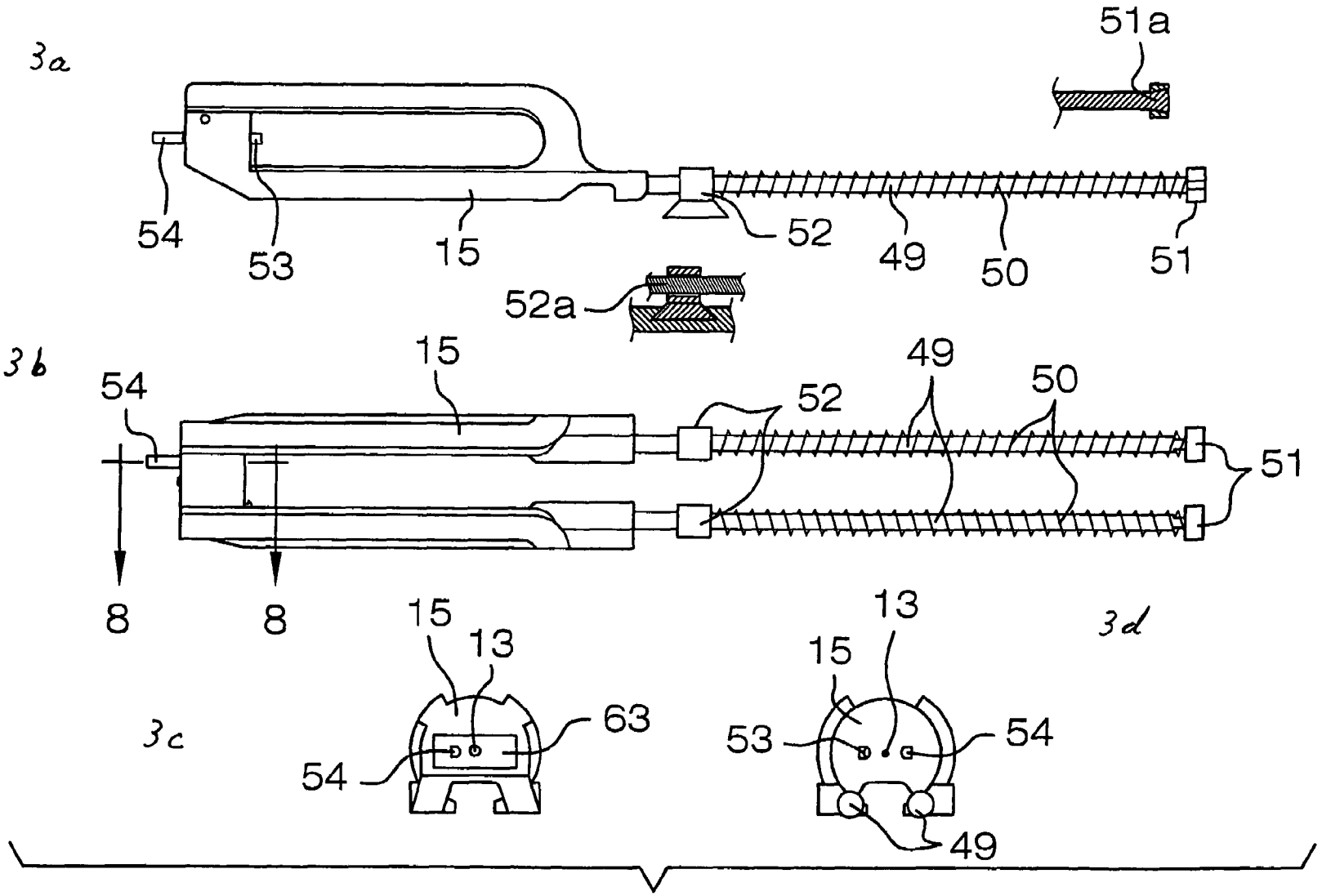
FIG. 3a-d

GAS OPERATED SEMI-AUTOMATIC RIFLE

CROSS-REFERENCE TO RELATED APPLICATION

This application claims the benefit of U.S. Provisional Application 60/721,679, filed Sep. 30, 2005.

BACKGROUND OF INVENTION

The present invention relates to a gas operated semi-automatic rifle having a forwardly moving gas piston which allows a breechblock of the rifle to not pass totally beyond a cartridge magazine to load a new cartridge.

Currently most semi-automatic rifles are gas operated, with expanding gases in the rifle barrel developed by the firing of a cartridge causing a gas piston/piston rod combination to move rearward. The piston rod moves rearward and is connected to a bolt assembly for extraction of a cartridge, and the loading of another cartridge from the rifle's magazine. The bolt assembly must clear the magazine entirely before a new cartridge is placed in the chamber for firing.

For example, U.S. Pat. No. 5,123,329 discloses a trigger mechanism that when activated causes an inner movable barrel to move towards the breech block. A piston attached to the muzzle provides momentum to forwardly move the barrel past the cartridge feeding mechanism. When moving backwardly the inner barrel picks up a new cartridge to force against the firing pin of the breech block. U.S. Pat. Nos. 5,351,598 and 5,520,019 reveal the M16 gas piston assemblies variation wherein the piston moves rearward in relation to the bolt assembly. These semi-automatic rifles are based upon the piston moving rearward and activating the breechblock with a turning locking head.

It is an object of the present invention to provide a gas operated semi-automatic rifle having a gas piston under the discharge end of the barrel which ultimately moves the breechblock. Such a design allows the gas piston to be connected to a locking mechanism which in turn provides the rearward impetus for the breechblock in reloading a cartridge from the rifle magazine.

It is a further object of the invention to provide a breechblock which moves fore and aft, without a turning head, to load a new cartridge after discharge.

It is a feature of the invention that the gas piston, locking mechanism and breechblock combination move in synchrony using fewer moving parts and providing greater stability in operation of the rifle.

It is an advantage of the present invention that a gas operated semi-automatic rifle is provided which is lightweight and shorter in length, thus leading to ease of use and greater accuracy.

SUMMARY OF THE INVENTION

The general purpose of the present invention, which will be described subsequently in greater detail, is to provide a new and improved semi-automatic rifle with less movement of heavier parts.

To attain this, the present invention comprises, in combination, a rifle with a gas piston located under its barrel. During operation, when the piston receives the expanding gases from a fired cartridge, the piston moves a short distance forward. The gas piston is connected to a locking mechanism via a piston rod. The piston rod is not connected to a breechblock, as is present in many current models of gas operated semi-automatic rifles. When the gas piston and the piston rod move forward, the gas piston and piston rod disengage the locking mechanism from the breechblock.

The breechblock is located at the entry end of the rifle barrel. The barrel is positioned in a lower corps, and the breechblock is engaged to the barrel by the locking mechanism. When the locking mechanism disengages from the breechblock, the breechblock moves rearward and loads a new cartridge from a rifle magazine. The magazine is located rearward of the breechblock and trigger mechanism.

Most semi-automatic rifles currently in service are based on gas-propelled piston moving rearward and activating a breechblock with a turning locking head. This requires a number of heavy parts moving together. An advantage of the present invention is that the gas piston only moves a short distance forward and the breechblock moves rearward when loading a cartridge without turning in relation to its longitudinal axis.

BRIEF DESCRIPTION OF THE DRAWINGS

The invention will be better understood and objects other than those set forth above will become apparent when consideration is given to the following detailed description thereof. Such description makes reference to the annexed drawings wherein:

FIGS. 3*a*, 3*b*, 3*c* and 3*d* are, respectively, a side view, top view, rear view and front view of the breechblock of the present invention.

DETAILED DESCRIPTION OF THE INVENTION

Figure 2:
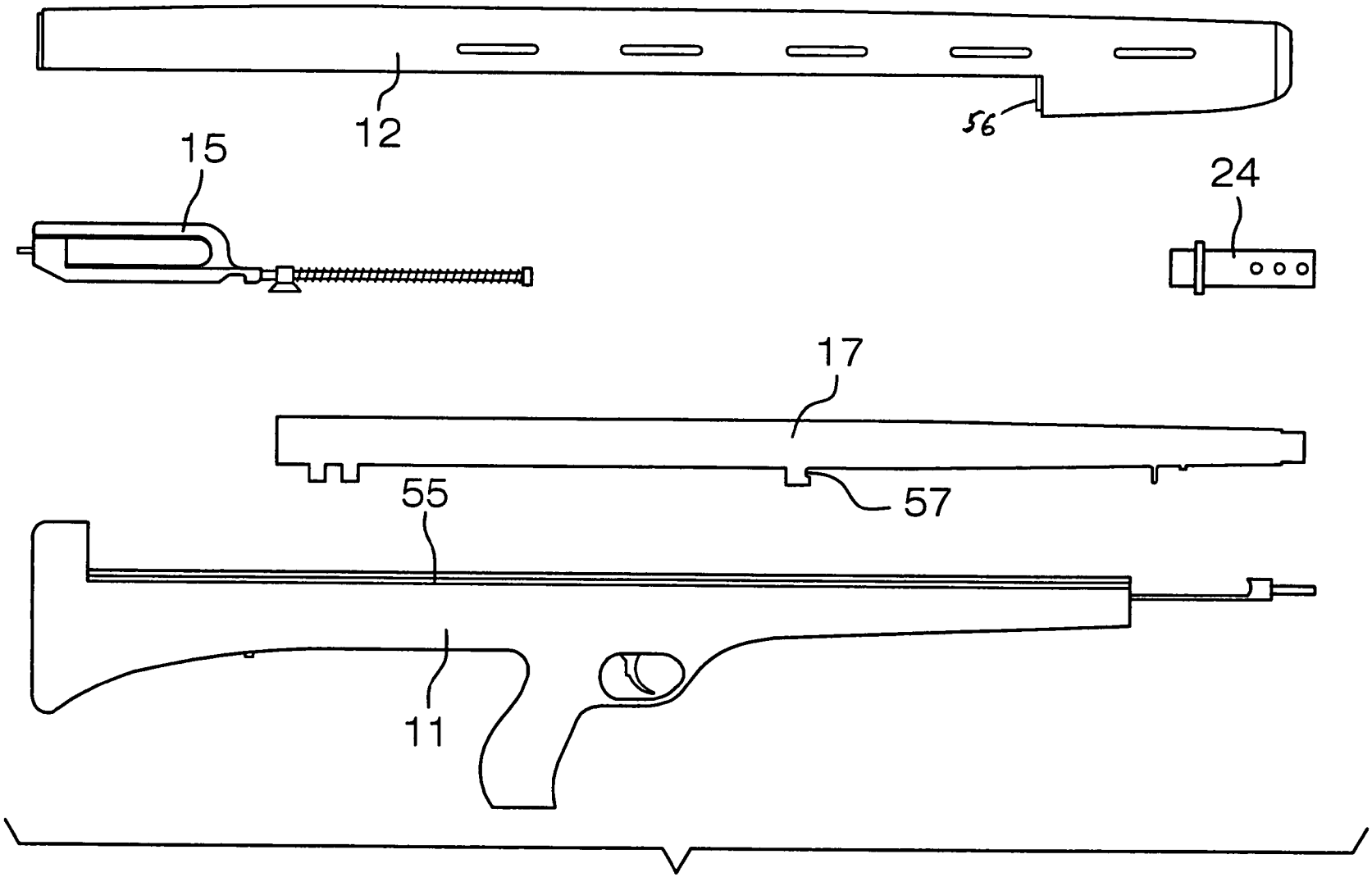
FIG. 2 is an exploded side view of some components of the present invention.

FIG. 2 illustrates the main housing components of the invention 10 having an upper corps 12 and a lower corps 11. The relative positioning of a barrel 17, a breechblock 15 and a barrel compensator 24 are also illustrated in FIG. 2.

Figure 1A:
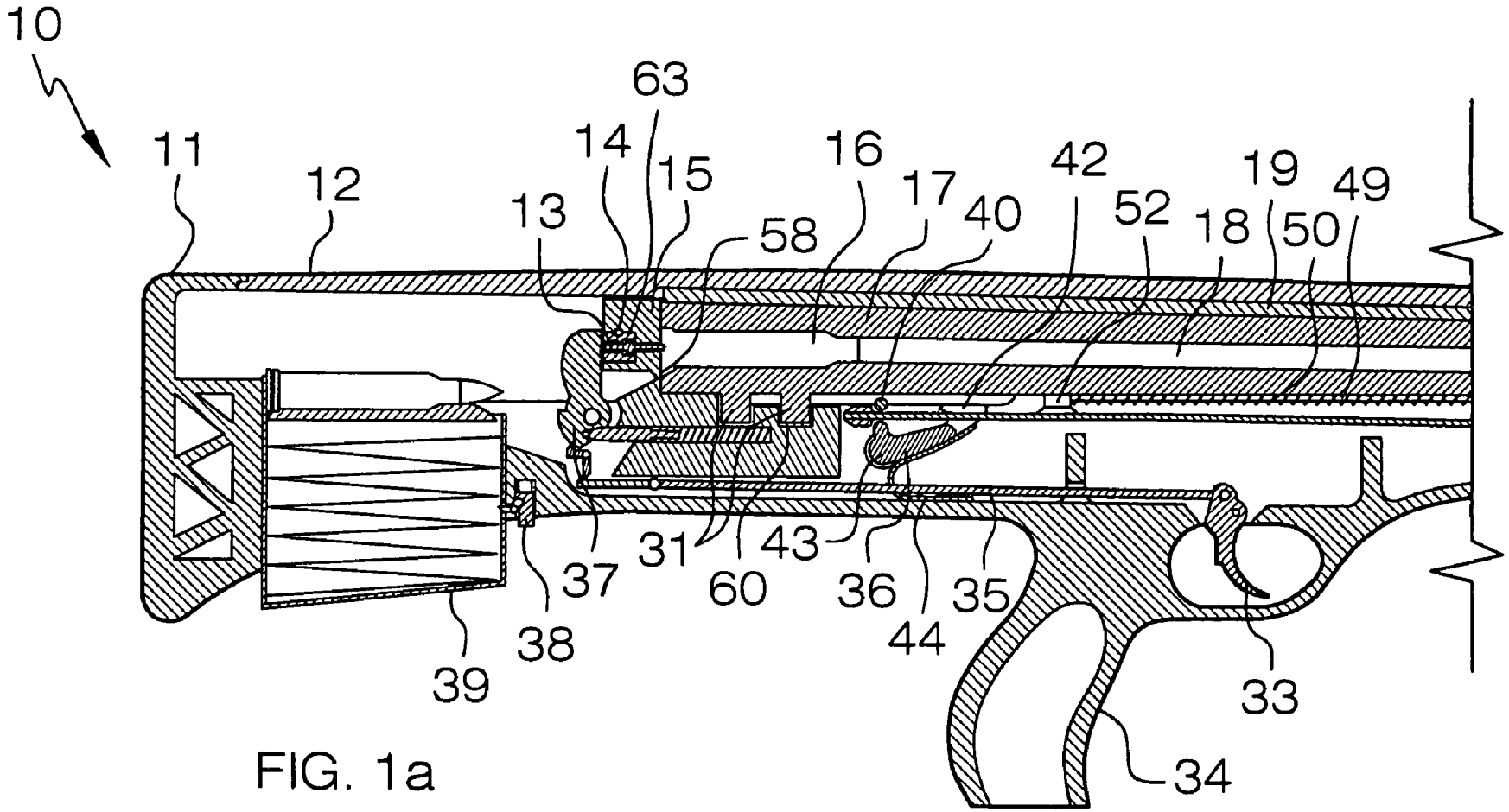
FIG. 1*a* is a cross sectional side view of the rear area of the present invention.
Figure 1B:
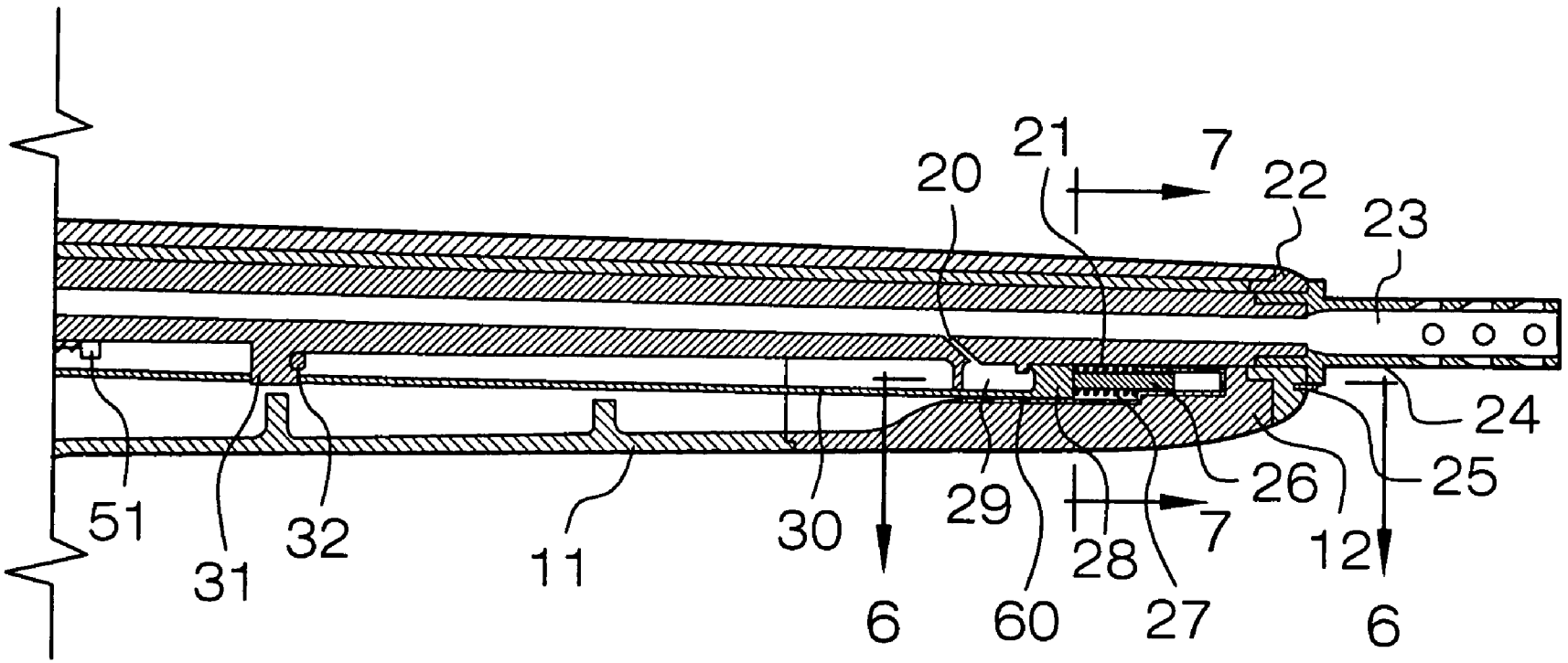
FIG. 1*b* is a cross sectional side view of the front area of the present invention.

Now with reference to FIGS. 1*a*, 1*b* and 2, the lower corps 11 has a bottom surface, side walls and a front and rear section, along with a top perimeter channel 55. A cavity is defined by the side walls. A locking mechanism 36, a gas piston 28 and piston rod 30 are contained within the cavity of the lower corps 11. Near the rear section of the lower corps 11, a magazine 39 with rifle cartridges is located and is secured to the lower corps 11 via a magazine ketch 38. The barrel 17 is securely mounted within the inner channel of the lower corps 11. Preferably the channel is lined with sheet metal to increase the strength of connection with the barrel 17. The lining of the channel is further constructed as channels to direct the movement of the breechblock 15. The top perimeter edge 55 allows the lower corps 11 to mate with the upper corps 12. Space for the magazine 39 is also provided, and the lower corps 11 has lining comprised of sheet metal 60 to increase its strength and to receive the barrel 17.

Figure 6:
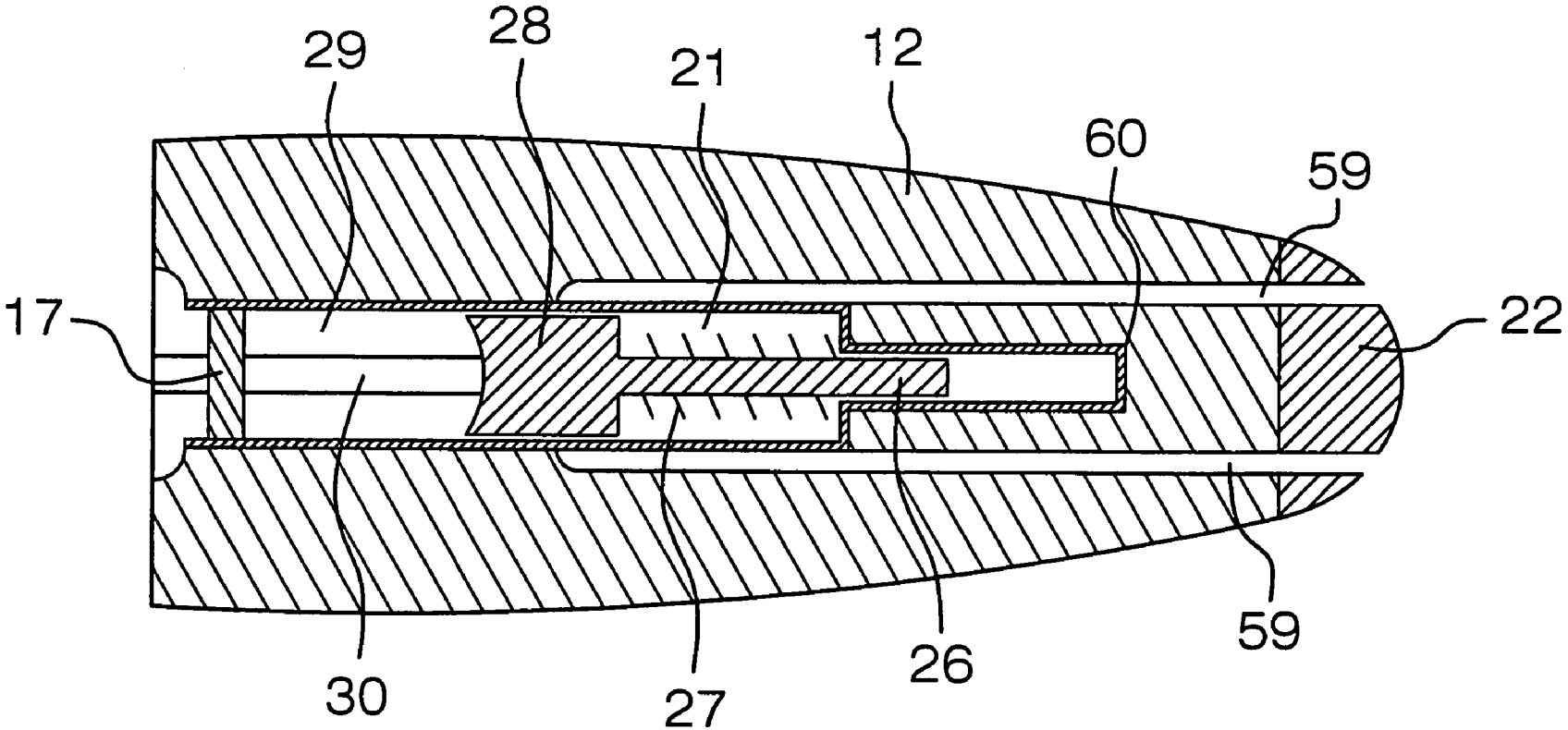
FIG. 6 is a cross sectional view of the gas piston and chamber of FIG. 1*b* taken at line 6-6 of FIG. 1*b*.

The upper corps 12 has a top surface, side walls and a front and rear section, along with a bottom perimeter ridge 56. The bottom perimeter ridge 56 slides into the top perimeter channel 55 of the lower corps 11 to mate the upper corps 12 with the lower corps 11. As illustrated in FIG. 6, a chamber 21 is integrally formed in the upper corps 12 for the gas piston 28 near the front end of the upper corps 12. Longitudinal channels 59 can be provided on the walls of the gas piston chamber 21. When in the back position the piston 28 covers the channels 59. After its movement forward, the piston 28 passes in front of the channels 59 and relieves excessive amount of gases. The upper corps 12 contains a vibration-absorbing pad 19, which after assembly stays on top of the barrel 17 and presses the barrel 17 down. At the distal end of the upper corps 12 a metal ring 22 is contained, and the ring 22 surrounds the front end of the barrel 17 and makes contact with the barrel compensator 24. The ring 22 also contains a small fixing pin 25, which keeps the compensator 24 in position after the compensator 24 is tightened.

The barrel 17, having a rifled bore 18 extending forwardly along a longitudinal axis toward a discharge end, a cartridge chamber 16, and having a breech 58 integrally formed with the bore 18. The barrel 17 has hills 31 to provide stability in the lower corps 11 and a generally circular shaped ketch 57 (illustrated in FIG. 2) where an eccentric pin from the lower corps 11 fixes its position. The lower surface of the breech 58 is shaped sloping to direct the cartridge, when pushed by the breechblock 15. At its discharge end the barrel 17 is outwardly threaded to mate with the compensator 24.

In typical operation, the rifle as illustrated in FIGS. 1*a* and 1*b* has a live round loaded in a cartridge chamber 16. The rifle is fired utilizing a trigger 33, grip 34, and a trigger rod 35 connected to a hammer 37. The cartridge is ignited by a firing pin 13. The gas piston 28 and the piston rod 30 are mounted in the lower corps 11, with the gas piston 28 being located under the barrel 17. The gas piston 28 and piston rod 30 are flexibly connected to the locking mechanism 36, and form a lever system. Gases are produced by the explosion of a rifle cartridge and movement of the round down the barrel 17. The expanding gases from the cartridge explosion enter an opening 20 in the barrel wall approximately 100 mm before its discharge end, and enter an expansion chamber 29 formed rearward of the gas piston 28. The expanding gases move the gas piston 28 approximately 15 mm forward. The piston rod 30 pulls the locking mechanism 36 and rotates the locking mechanism 36 along its axis. The rotational movement pulls down the locking mechanism 36, and the breechblock 15 is released.

As illustrated in FIG. 6, the gas piston 28 is generally square in cross-section, and its top surface is juxtaposed to slide along the bottom surface of the barrel 17 when in operation. The gas piston 28 is surrounded on three of its sides by the upper corps 12.

Figure 7:
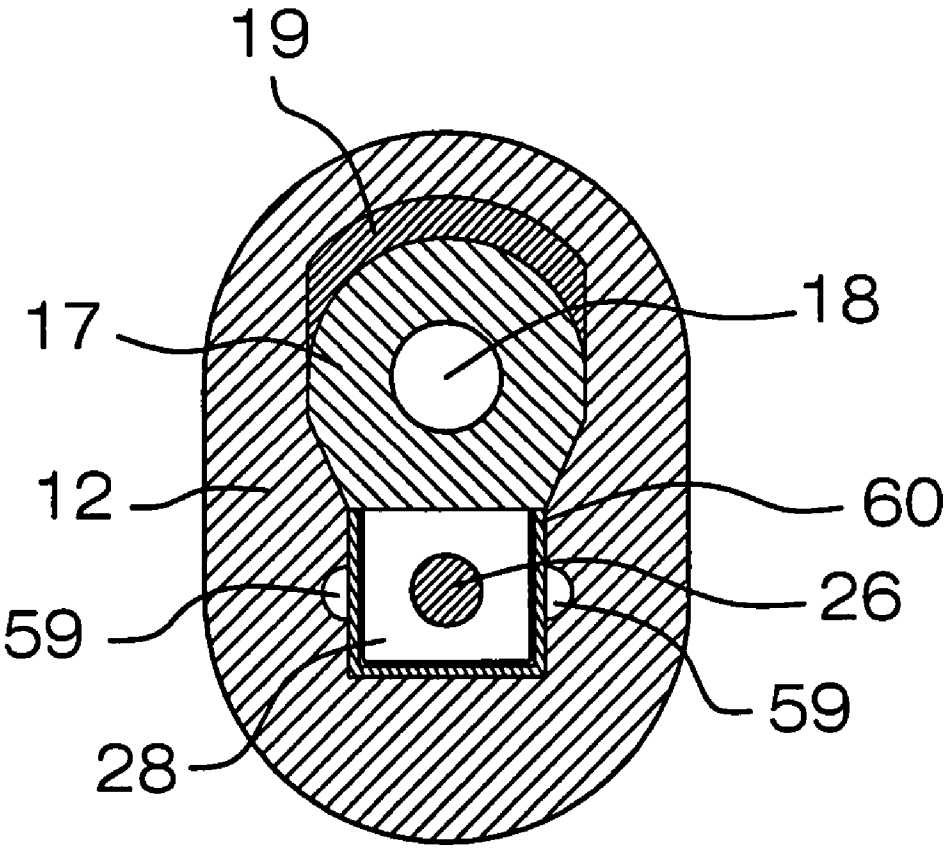
FIG. 7 is a cross sectional view of the gas piston and chamber of FIG. 1*b* taken at line 7-7 of FIG. 1*b*.

As further illustrated in FIGS. 6 and 7, the distal end of the gas piston 28 is integrally formed as a bar 26, with a spring 27 surrounding the bar 26. The bar 26 is mounted within the lower corps 11, and the spring 27 fixes the movement of the gas piston 28, reduces its speed and returns the gas piston 28 to its back position. The expanding gases from the cartridge explosion entering the expansion chamber 29 delay the movement of the gas piston 28 so that the breechblock 15 opens at the first end of the barrel 17 only after the pressure in the bore 18 is reduced.

Figure 4B:
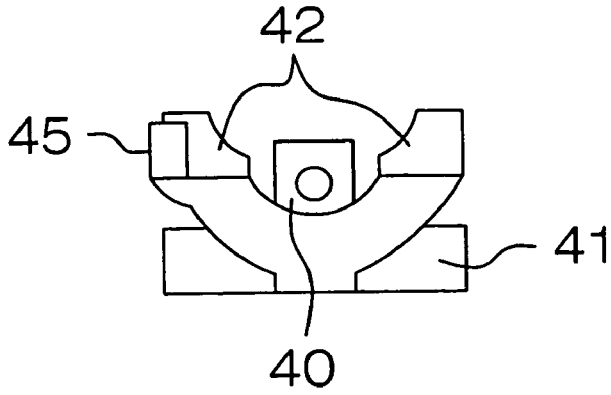
FIGS. 4*a*, 4*b* and 4*c* are, respectively, a side view, front view and top view of the locking mechanism of the present invention.
Figure 4A:
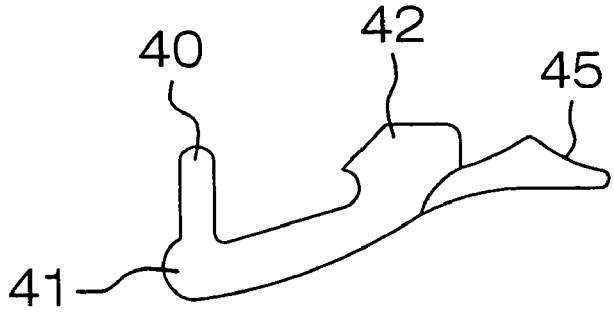
Figure 4C:
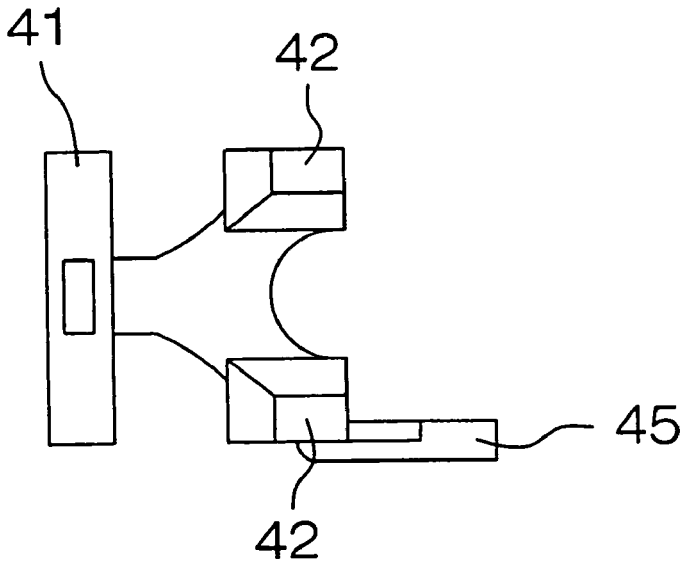

A detailed illustration of the locking mechanism 36 is shown in FIGS. 4*a*, 4*b* and 4*c*. The locking mechanism 36 is mounted in the lower corps 11 of the rifle. Two locking fingers 42 and an operating lever 40 are integrally formed as part of the locking mechanism 36. An arm 41, mounted in cylinders 43 (illustrated in FIG. 1*a*) built into the side walls of the lower corps 11, allows the locking mechanism 36 to rotate along its axis. As shown in FIG. 1*a*, a spring 44 keeps the locking mechanism 36 in an upper position. The right locking finger 42 has an appendage 45 with a sloping surface which contacts with a loading handle 48 for initial loading. The piston rod 30 passes between the locking fingers 42 and through the operating lever 40 of the locking mechanism 36.

Figure 5B:
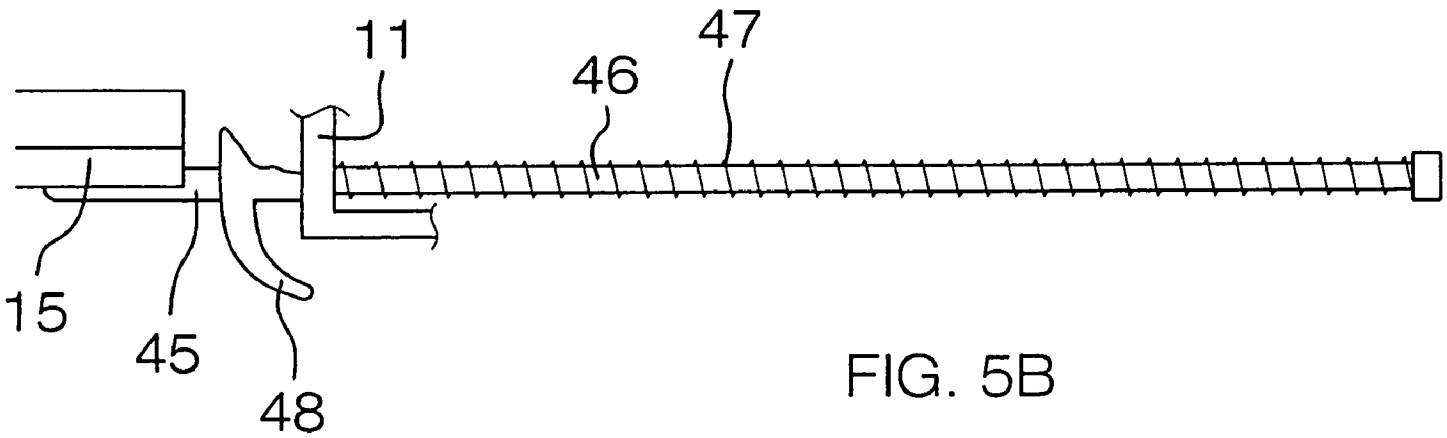
FIGS. 5*a* and 5*b* are, respectively, a side view and top view of the initial loading mechanism of the present invention.
Figure 5A:
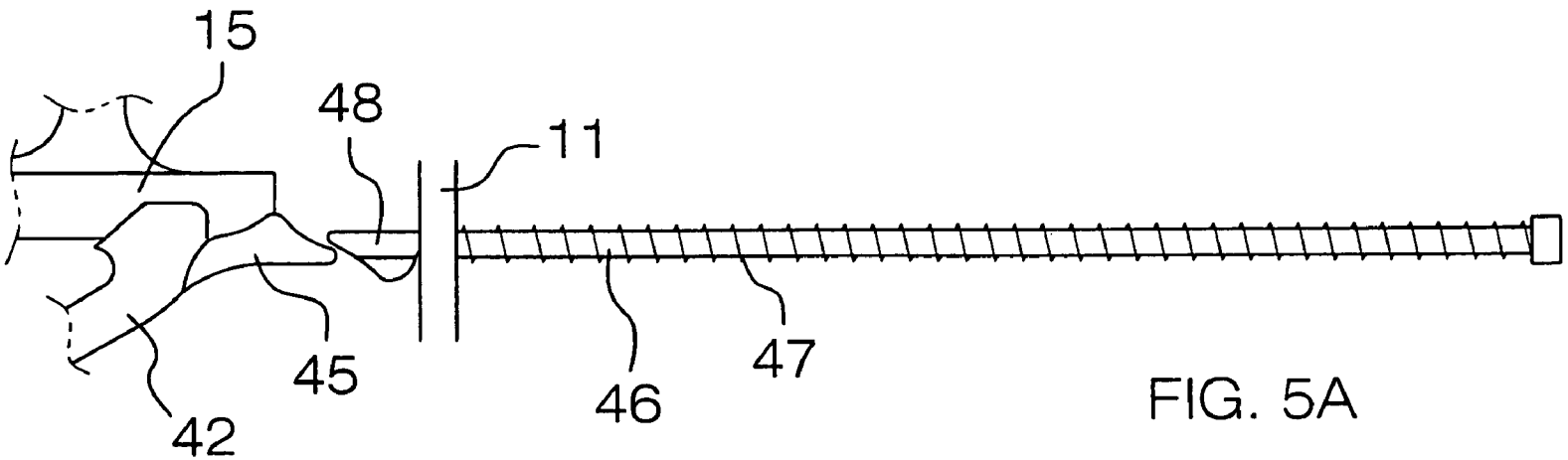
Figure 9:
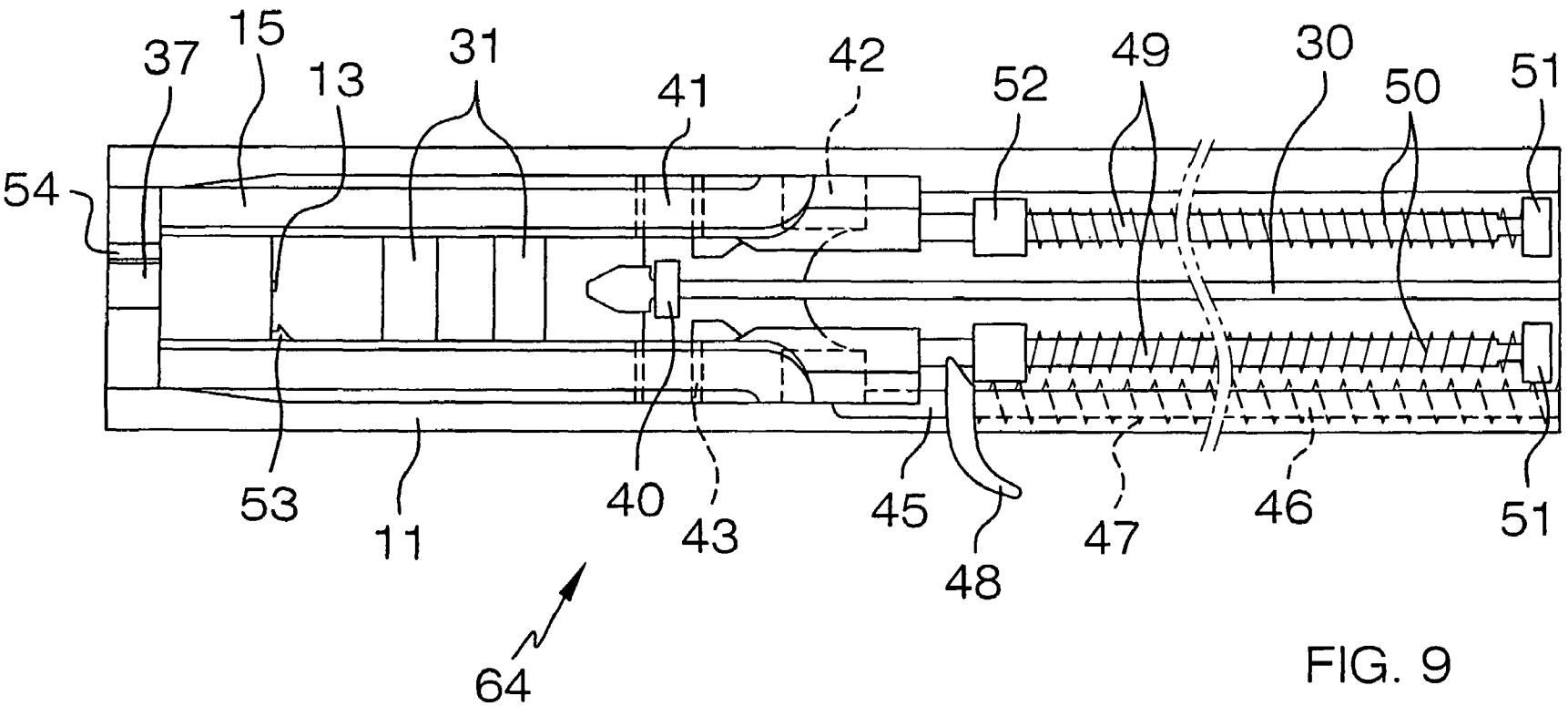
FIG. 9 is a cross sectional top view of the present invention of the breechblock, the locking mechanism and the loading mechanism, when the barrel is removed.

The loading mechanism 64 is located in the right wall of the lower corps 11, and illustrated in FIGS. 5*a*, 5*b* and 9. It is comprised of a rod 46 with a spring 47 and the loading handle 48. When pulled back manually by a user of the rifle the handle 48 makes contact with the appendage 45 of the right locking finger 42 of the locking mechanism 36, and pushes the right locking finger 42 downwardly. The breechblock 15 is released and is pushed back manually with the handle 48. Moving rearward the breechblock 15 engages and rotates the hammer 37, which is then set in a cocked position. At the final rearward the spring 47 is compressed. When the loading handle 48 is released the spring 47 returns to its former position. The breechblock 15 is now disengaged, and recoil springs 50 bias the breechblock 15 forward. The breechblock 15 strips a new top cartridge from the magazine 39 and positions the new cartridge within the cartridge chamber 16 formed in the barrel 17, loading the rifle. The loading mechanism 64 remains immovable during firing.

Figure 8:
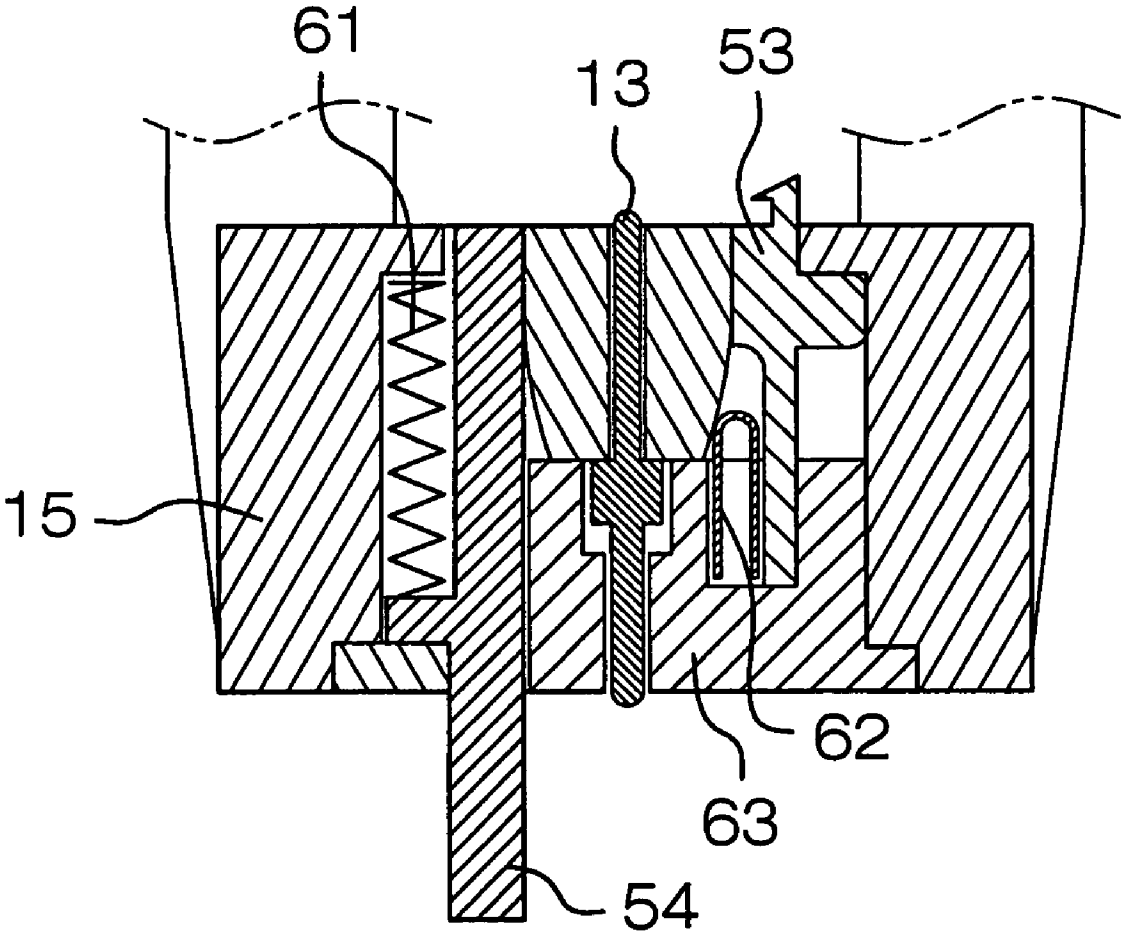
FIG. 8 is a cross sectional view of the breechblock of FIG. 3*b* taken at line 8-8 of FIG. 3*b*.

Details of the breechblock 15 are illustrated in FIGS. 3 *a-d* and FIG. 8. The breechblock 15 has a first and second end, and surrounds the entry end of the barrel 17. The breechblock 15 is coupled with the hammer 37. When in the front position the breechblock 15 is juxtaposed behind the barrel 17. At its final rearward position, after striping a cartridge from the magazine 39, the breechblock 15 will pass approximately only 20 mm behind the magazine 39. The total length of the rifle is thus reduced.

Recoil rods 49, having first and second ends, extend from the first end of the breechblock 15. Recoil springs 50 are positioned on the recoil rods 49. The recoil rods 49 are engaged to fixing rings 51 at the second end of the recoil rods 49. The second end of the recoil rods 49 and the fixing rings 51 are shaped conically which allows the rods 49 and the fixing rings 51 to engage. The sliding rings 52, having an opening with a diameter greater than the diameter of the recoil rods 49, are mounted in an immobile position in the lower corps 11. The recoil rods 49 are extended through the opening of the sliding rings 52. The breechblock 15, when disengaged from the locking mechanism 36, can move rearward along a longitudinal axis. The breechblock 15, recoil rods 49 and fixing rings 51 move as an integral unit longitudinally. The recoil springs 50 bias the movement of the breechblock 15 during reloading. The breechblock 15, and gas piston 28 and piston rod 30, move fore and aft, and in opposite directions.

As illustrated in FIG. 8, the breechblock 15 has a firing pin 13. An extractor 53, extractor spring 62, an ejector 54 and ejector spring 61, act in combination to remove spent cartridges. A breechblock plug 63 is mounted in position in the breechblock 15, and the extractor 53 and the ejector 54 are positioned therein. The breechblock plug 63 keeps the extractor 53 and ejector 54 in position and limits the movement of the firing pin 13. A fixing pin 14 (shown in FIG. 1A) keeps the breechblock plug 63 in position. The extractor 53 and the ejector 54 are interchangeable for use by left or right handed shooters by changing the positions of the extractor 53 and the ejector 54, and by rotating the breechblock plug 63.

The extractor 53 has a first end and a second end, with a hooked shaped portion depending from the first end of the extractor 53. After firing of a round, and as the breechblock 15 moves rearward, the hooked shaped portion of the extractor 53 removes the spent cartridge from the cartridge chamber 16. The ejector 54 propels the spent cartridge form the rifle 10, and allows the breechblock to reload another round.

The barrel compensator 24, in addition to reducing recoil, completes the rifle assembly. The barrel compensator 24 is inwardly treaded to mate with the discharge end of the barrel 17. When in its fixed position, the compensator 24 moves the barrel 17 forward. Since the barrel 17 is already fixed in the lower corps 11 the tightening of the compensator 24 pushes the upper corps 12 rearward. As a result the front end of the barrel 17 is secured against vibrations. The fixing pin 25 of the upper corps 12 keeps the compensator 24 on final position. A chamber 23 is integrally formed at the beginning of the compensator 24 to collect burning gases from the projectile explosion.

To assemble the rifle, first insert the rear end of the barrel 17 into the breechblock 15 and place both the barrel 17 and breechblock 15 into the lower corps 11. The position of the barrel 17 is fixed with an eccentric pin 32. Rear rings 52 of the recoil springs 50 are secured. The upper corps 12 is slide fully rearward, and the barrel compensator 24 is mounted to the barrel 17 to bias the upper corps 12 rearward. The barrel compensator 24 is fixed into position with the pin 25.

With respect to the above description then, it is to be realized that the optimum dimensional relationships for the parts of the invention, to include variations in size, materials, shape, form, function, and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, if is not desired to limit the invention to the exact construction and operation shown and described, and accordingly, all suitable modifications and equivalents may be resorted to, falling within the scope of the invention.

I claim:

1. A gas operated semi-automatic rifle comprising the combination of:

a lower corps having a bottom surface, side walls, first end, second end and a top perimeter channel, having an open cavity defined by the side walls, having an expansion chamber defined within the cavity positioned near the second end, and having a cartridge magazine adapted to fit near the first end;

an upper corps having a top surface, side walls, first end, second end and a bottom perimeter ridge which is slidably mated with the top perimeter channel of the lower corps;

a barrel, having a first end and a discharge end, mounted within the lower corps and having a rifled bore extending forwardly toward the discharge end, the barrel further comprising a cartridge chamber and a breech integrally formed with the bore therein, and the barrel having a gas port opening passing from the bore into the expansion chamber of the lower corps;

a breechblock mounted near the first end of the lower corps, and having a first end, a second end and a firing pin, and the breechblock being juxtaposed near the first end of the barrel;

a gas piston having a first end and a second end, a piston rod connected to the first end of the gas piston contained within the cavity of the lower corps, the piston rod flexibly connected to a locking mechanism mounted in the lower corps, the gas piston and the piston rod positioned forward of the expansion chamber of the lower corps, and the locking mechanism being engaged with the breechblock;

a trigger, a grip and a trigger rod connected to a hammer; the hammer being positioned to be cocked by the breechblock; and as the cartridge chamber receives a rifle cartridge, the cartridge is ignited by the firing pin of the breechblock by pulling the trigger engaging the hammer with the breechblock, whereby expanding gases entering the expansion chamber act upon the gas piston to rotate the locking mechanism, disengaging the breechblock, and allowing the breechblock to reload another cartridge.

2. The rifle of claim 1, further comprising:

a bar integrally formed at the second end of the gas piston;

a spring fixedly mounting the bar within a chamber formed in the upper corps to allow bias movement of the gas piston by the spring.

3. The rifle of claim 1, whereby the locking mechanism further comprises a first and a second locking finger, the second locking finger having an appendage with a sloping surface, and the locking mechanism being rotatably mounted in cylinders disposed in the lower corps.

4. The rifle of claim 3, further comprising:

a loading mechanism located in the lower corps having a spring positioned on a rod, the rod having a first end and a second end;

a loading handle extending from the first end of the rod, the loading handle contacting the appendage of the second locking finger of the locking mechanism to allow downward movement of the second locking finger upon the rearward movement of the loading handle; and whereby the breechblock is disengaged from the locking mechanism upon the downward movement of the second locking finger allowing the breechblock to load a cartridge from the magazine.

5. The rifle of claim 1, further comprising:

a pair of recoil rods, having first and second ends, extending from the first end of the breechblock;

a pair of recoil springs surrounding the recoil rods;

a pair of fixing rings engaged to the second end of the recoil rods; and a pair of sliding rings each having an opening therethrough and being securely located in the lower corps, whereby the recoil rods are projected through the openings of the sliding rings.

6. A gas operated semi-automatic rifle comprising the combination of:

a lower corps having a bottom surface, side walls, first end, second end and a top perimeter channel, having an open cavity defined by the side walls, having an expansion chamber defined within the cavity positioned near the second end, and having a cartridge magazine adapted to fit near the first end;

an upper corps having a top surface, side walls, first end, second end and a bottom perimeter ridge which is slidably mated with the top perimeter channel of the lower corps;

a barrel, having a first end and an outwardly threaded discharge end, mounted within the lower corps and having a rifled bore extending forwardly toward the discharge end, the barrel further comprising a cartridge chamber and a breech integrally formed with the bore therein, and the barrel having a gas port opening passing from the bore into the expansion chamber of the lower corps;

a breechblock mounted near the first end of the lower corps, and having a first end, a second end and a firing pin, and the breechblock being juxtaposed near the first end of the barrel;

a gas piston having a first end and a second end, a piston rod connected to the first end of the gas piston contained within the cavity of the lower corps, the piston rod flexibly connected to a locking mechanism mounted in the lower corps, the gas piston and the piston rod positioned forward of the expansion chamber of the lower corps, and the locking mechanism being engaged with the breechblock;

a barrel compensator having a first end and a second end, the first end being inwardly threaded, the first end of the barrel compensator being mated with the discharge end of the barrel;

a trigger, a grip and a trigger rod connected to a hammer; the hammer being positioned to be cocked by the breechblock; and as the cartridge chamber receives a rifle cartridge, the cartridge is ignited by the firing pin of the breechblock by pulling the trigger engaging the hammer with the breechblock, whereby expanding gases entering the expansion chamber act upon the gas piston to rotate the locking mechanism, disengaging the breechblock, and allowing the breechblock to reload another cartridge.

7. The rifle of claim 6, further comprising:

a bar integrally formed at the second end of the gas piston;

a spring fixedly mounting the bar within a chamber formed in the upper corps to allow bias movement of the gas piston by the spring.

8. The rifle of claim 6, further comprising:

a pair of recoil rods, having first and second ends, extending from the first end of the breechblock;

a pair of recoil springs surrounding the recoil rods;

a pair of fixing rings engaged to the second end of the recoil rods; and a pair of sliding rings each having an opening therethrough and being securely located in the lower corps, whereby the recoil rods are projected through the openings of the sliding rings.

* * * * *